US009238247B1

(12) United States Patent
Giraldo

(10) Patent No.: US 9,238,247 B1
(45) Date of Patent: Jan. 19, 2016

(54) PAINT ROLLER ASSEMBLY

(71) Applicant: Julian Giraldo, Marietta, GA (US)

(72) Inventor: Julian Giraldo, Marietta, GA (US)

( * ) Notice: Subject to any disclaimer, the term of this patent is extended or adjusted under 35 U.S.C. 154(b) by 0 days.

(21) Appl. No.: 14/317,752

(22) Filed: Jun. 27, 2014

(51) Int. Cl.
*B05C 17/02* (2006.01)

(52) U.S. Cl.
CPC ..... *B05C 17/0245* (2013.01); *B05C 17/02* (2013.01)

(58) Field of Classification Search
CPC .. B05C 17/02; B05C 17/0245; B05C 17/0225
See application file for complete search history.

(56) References Cited

U.S. PATENT DOCUMENTS

| | | | | |
|---|---|---|---|---|
| 2,825,916 | A | 3/1958 | Basala, Jr. | |
| 2,860,858 | A | 11/1958 | Kurs | |
| 3,019,467 | A | 2/1962 | Garrett | |
| 4,317,248 | A * | 3/1982 | Smith | 15/145 |
| 4,324,018 | A | 4/1982 | Olsson | |
| 4,667,361 | A | 5/1987 | Wolcott et al. | |
| 5,539,948 | A | 7/1996 | McCauley et al. | |
| 5,546,625 | A | 8/1996 | Mealey, Sr. | |
| D386,857 | S | 11/1997 | Lawrence | |
| 7,281,292 | B1 * | 10/2007 | Felix | 15/230.11 |
| 2003/0126711 | A1 * | 7/2003 | Korenevsky | 15/230.11 |

FOREIGN PATENT DOCUMENTS

DE 101 12 224 A1 * 9/2002

* cited by examiner

*Primary Examiner* — Randall Chin

(57) ABSTRACT

A paint roller assembly facilitates the process of cleaning excess paint from a paint roller cover. The assembly includes a handle having a first end and a second end. A roller frame is coupled to and extends from the first end of the handle. A cage is coupled to a distal end of the roller frame with respect to the handle. The cage is cylindrical and configured for receiving a paint roller cover thereon such that the paint roller cover extends around the cage. The cage extends transversely relative to the handle. A blade is coupled to and extends from the roller frame. The blade has a first surface and a second surface each being planar. The blade is configured for removing paint from the paint roller cover when the paint roller cover is removed from the cage and rubbed against the blade.

8 Claims, 3 Drawing Sheets

PAINT ROLLER ASSEMBLY

BACKGROUND OF THE DISCLOSURE

Field of the Disclosure

The disclosure relates to paint roller devices and more particularly pertains to a new paint roller device for facilitating the process of cleaning excess paint from a paint roller cover.

SUMMARY OF THE DISCLOSURE

An embodiment of the disclosure meets the needs presented above by generally comprising a handle having a first end and a second end. A roller frame is coupled to and extends from the first end of the handle. A cage is coupled to a distal end of the roller frame with respect to the handle. The cage is cylindrical and configured for receiving a paint roller cover thereon such that the paint roller cover extends around the cage. The cage extends transversely relative to the handle. A blade is coupled to and extends from the roller frame. The blade has a first surface and a second surface each being planar. The blade is configured for removing paint from the paint roller cover when the paint roller cover is removed from the cage and rubbed against the blade.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
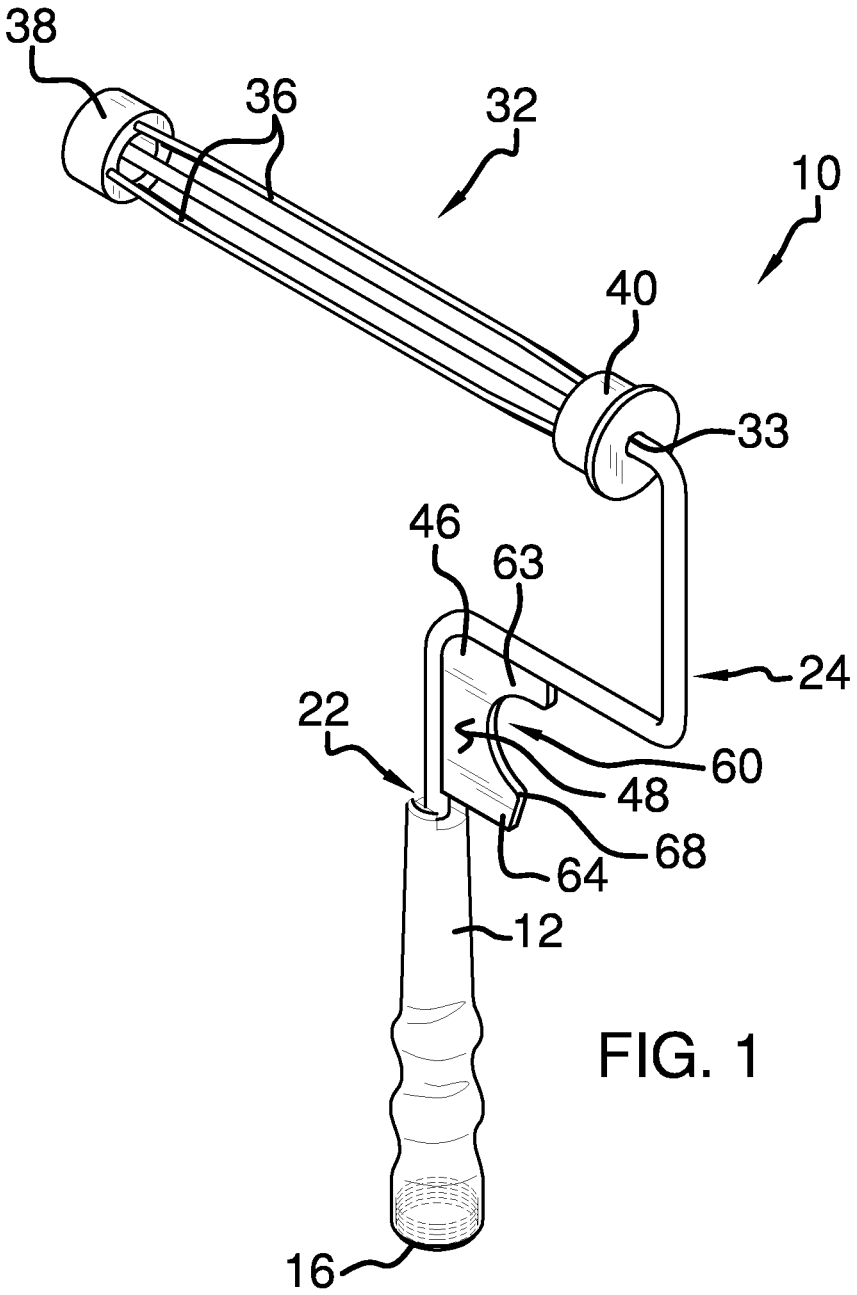
FIG. 1 is a top front side perspective view of a paint roller assembly according to an embodiment of the disclosure.
Figure 2:
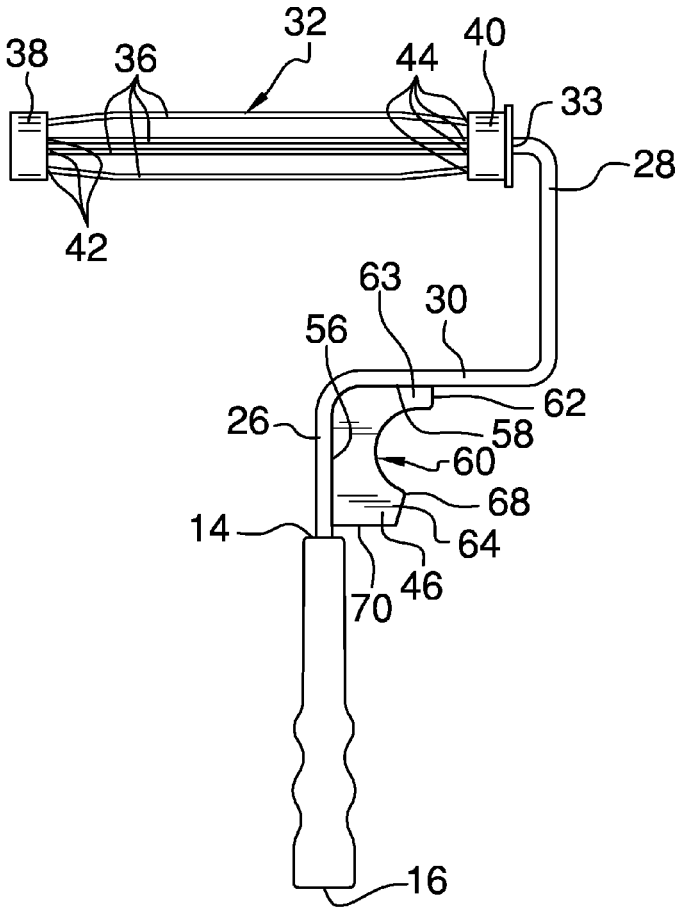
FIG. 2 is a front view of an embodiment of the disclosure.
Figure 3:
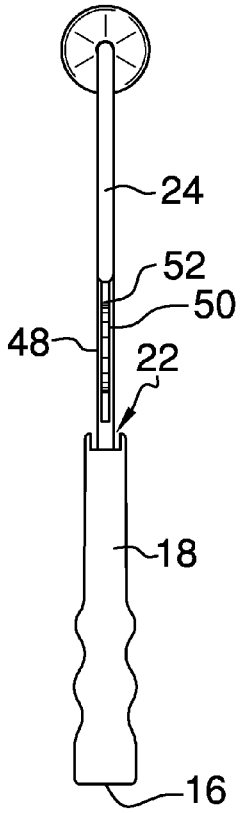
FIG. 3 is a side view of an embodiment of the disclosure.
Figure 4:
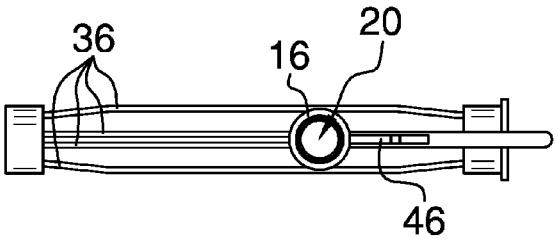
FIG. 4 is a bottom view of an embodiment of the disclosure.
Figure 5:
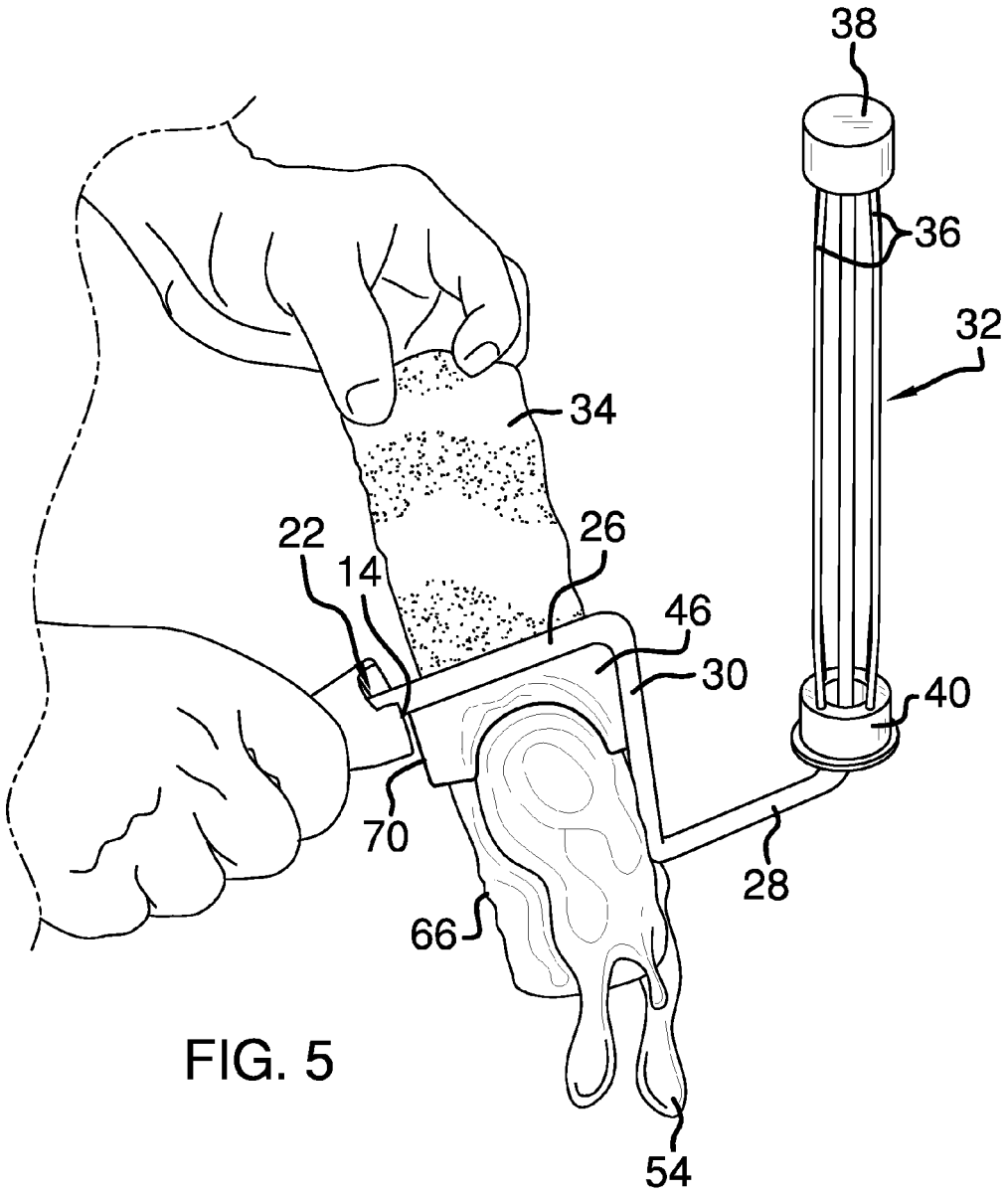
FIG. 5 is an in-use perspective view of an embodiment of the disclosure.

With reference now to the drawings, and in particular to FIGS. 1 through 5 thereof, a new paint roller device embodying the principles and concepts of an embodiment of the disclosure and generally designated by the reference numeral 10 will be described.

As best illustrated in FIGS. 1 through 5, the paint roller assembly 10 generally comprises a handle 12 having a first end 14 and a second end 16. The handle 12 may include a grip 18. The second end 16 of the handle 16 has an opening 20 extending therein. The opening 20 is threaded and configured for attaching the second end 16 of the handle 12 to a threaded end of an extension pole. The first end 14 of the handle 12 may have an indentation 22 positioned therein wherein the indentation 22 is configured for receiving a lip of a bucket therein to support the handle 12 against the bucket.

A roller frame 24 is coupled to and extends from the first end 14 of the handle 12. The roller frame 24 has a lower section 26, an upper section 28 and a medial section 30 attached to and extending between the lower section 26 and the upper section 28. The lower section 26 is attached to the first end 14 of the handle 12 and is positioned parallel with respect to a longitudinal axis extending through the first end 14 and the second end 16 of the handle 12.

A cage 32 is coupled to a distal end 33 of the roller frame 24 with respect to the handle 12. The cage 32 is cylindrical and configured for receiving a conventional paint roller cover 34 thereon such that the paint roller cover 34 extends around the cage 32. The cage 32 is comprised of a plurality of wires 36 and includes a pair of end caps 38, 40. One of the end caps 38 is coupled to an associated first end 42 of each of the wires 36 and one of the end caps 40 is coupled to an associated second end 44 of each of the wires 36. The cage 32 extends transversely relative to the handle 12. The upper section 28 of the roller frame 24 is attached to the cage 32.

A blade 46 is coupled to and extends from the roller frame 24 and may be integrally coupled to the roller frame 24. The blade 46 has a first surface 48, a second surface 50 and a perimeter edge 52 extending between the first surface 48 and the second surface 50. Each of the first 48 and second 50 surfaces is planar. The blade 46 is configured for removing paint 54 from the paint roller cover 34 when the paint roller cover 34 is removed from the cage 32 and rubbed against the blade 46. The blade 46 may be coupled to the roller frame 24 proximate the handle 12. The blade 46 has a first side 56 that may be coupled to the lower section 26 of the roller frame 24 and a second side 58 that may be coupled to the medial section 30 of the roller frame 24.

The blade 46 has a notch 60 extending inwardly into an associated side 62 of the perimeter edge 52 defining a pair of spaced arms 63, 64. The notch 60 is arcuate and configured to substantially conform to a curvature of an outer surface 66 of the paint roller cover 34 wherein the notch 60 receives and abuts the outer surface 66 of the paint roller cover 34. The associated side 62 of the perimeter edge 52 may be slanted extending from a side edge 68 of the notch 60 to an adjacently positioned side 70 of the blade 46.

In use, the paint roller cover 34 is positioned on the cage 32 and is used to apply paint 34 to a surface in a conventional manner. After painting, the paint roller cover 34 is removed from the cage 32 and is scraped against the blade 46. In particular, the paint roller cover 34 is rubbed against the notch 60 in order to remove the paint 54 from the paint roller cover 34. The assembly 10 can be positioned above a tray, can or the like to collect the paint 54 removed from the paint roller cover 34. In this manner, the assembly 10 avoids the mess usually associated with cleaning a conventional paint roller.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paint roller assembly comprising:

a handle having a first end and a second end;

a roller frame coupled to and extending from said first end of said handle;

a cage coupled to a distal end of said roller frame with respect to said handle, said cage being cylindrical and configured for receiving a paint roller cover thereon such that the paint roller cover extends around said cage, said cage extending transversely relative to said handle; and a blade coupled to and extending from said roller frame, said blade being integrally coupled to said roller frame, said blade having a first surface and a second surface each being planar, said blade being configured for removing paint from the paint roller cover when the paint roller cover is removed from said cage and rubbed against said blade, said blade having a perimeter edge extending between said first surface and said second surface, said blade having a notch extending into an associated side of said of said perimeter edge defining a pair of spaced arms, said notch being arcuate and configured to substantially conform to a curvature of an outer surface of the paint roller cover wherein said notch receives and abuts the outer surface of the paint roller cover.

2. The assembly of claim 1, further comprising said associated side of said perimeter edge being slanted extending from a side edge of said notch to an adjacently positioned side of said blade.

3. The assembly of claim 1, further comprising said first end of said handle having an indentation positioned therein wherein said indentation is configured for receiving a lip of a bucket therein to support said handle against the bucket.

4. The assembly of claim 1, further comprising said handle including a grip.

5. The assembly of claim 1, further comprising said second end of said handle having an opening extending therein, said opening being threaded and configured for attaching said second end of said handle to a threaded end of an extension pole.

6. The assembly of claim 1, further comprising said blade being coupled to said roller frame proximate said handle.

7. The assembly of claim 1, further comprising said roller frame having a lower section, an upper section and a medial section attached to and extending between said lower section and said upper section, said lower section being attached to said first end of said handle, said upper section being attached to said cage, said lower section being positioned parallel with respect to a longitudinal axis extending through said first end and said second end of said handle, said blade having a first side coupled to said lower section and a second side coupled to said medial section.

8. A paint roller assembly comprising:

a handle having a first end and a second end, said handle including a grip, said second end of said handle having an opening extending therein, said opening being threaded and configured for attaching said second end of said handle to a threaded end of an extension pole;

said first end of said handle having an indentation positioned therein wherein said indentation is configured for receiving a lip of a bucket therein to support said handle against the bucket;

a roller frame coupled to and extending from said first end of said handle, said roller frame having a lower section, an upper section and a medial section attached to and extending between said lower section and said upper section, said lower section being attached to said first end of said handle, said lower section being positioned parallel with respect to a longitudinal axis extending through said first end and said second end of said handle;

a cage coupled to a distal end of said roller frame with respect to said handle, said cage being cylindrical and configured for receiving a paint roller cover thereon such that the paint roller cover extends around said cage, said cage extending transversely relative to said handle, said upper section of said roller frame being attached to said cage;

a blade coupled to and extending from said roller frame, said blade being integrally coupled to said roller frame, said blade having a first surface and a second surface each being planar, said blade being configured for removing paint from the paint roller cover when the paint roller cover is removed from said cage and rubbed against said blade, said blade having a perimeter edge extending between said first surface and said second surface, said blade being coupled to said roller frame proximate said handle, said blade having a first side coupled to said lower section of said roller frame and a second side coupled to said medial section of said roller frame; and said blade having a notch extending inwardly into an associated side of said of said perimeter edge defining a pair of spaced arms, said notch being arcuate and configured to substantially conform to a curvature of an outer surface of the paint roller cover wherein said notch receives and abuts the outer surface of the paint roller cover, said associated side of said perimeter edge being slanted extending from a side edge of said notch to an adjacently positioned side of said blade.

* * * * *